US006978520B2

(12) United States Patent
Falany

(10) Patent No.: US 6,978,520 B2
(45) Date of Patent: Dec. 27, 2005

(54) BUCKLE ASSEMBLY AND HAND-HOLD STRAP ATTACHMENT SYSTEM FOR HORSE REINS, BACKPACK STRAPS, CLIMBING ROPE, BELTS, AND THE LIKE

(75) Inventor: Wade H. Falany, Sonoma, CA (US)

(73) Assignee: Wade Hilton Falany, Sonoma, CA (US)

( * ) Notice: Subject to any disclaimer, the term of this patent is extended or adjusted under 35 U.S.C. 154(b) by 0 days.

(21) Appl. No.: 10/835,313

(22) Filed: Apr. 29, 2004

(65) Prior Publication Data

US 2004/0221429 A1 Nov. 11, 2004

Related U.S. Application Data

(60) Provisional application No. 60/468,370, filed on May 6, 2003.

(51) Int. Cl.[7] ..... A44B 11/10

(52) U.S. Cl. ..... 24/171; 24/165; 24/115 H; 24/115 M

(58) Field of Search ..... 54/74; 24/614, 24/615, 625, 171, 194, 196, 165, 181, 177, 24/115 H, 115 M, 136

(56) References Cited

U.S. PATENT DOCUMENTS 2,890,534 A * 6/1959 Quayle ..... 40/303
3,152,374 A * 10/1964 Round ..... 24/194

* cited by examiner

*Primary Examiner*—Jack W. Lavinder

(57) ABSTRACT

A buckle assembly includes a handhold or attachment type of strap system for horse reins, backpack straps, belts, climbing rope, and the like. The female portion of the mating assembly that forms the buckle permits a strap to pass through such that the latchable engagement of the male member of the buckle, upon insertion into the female portion, fixes the position of the buckle by frictionally engaging the strap. At least one or both of the male and female members may also include a loop type-connecting strap that provides a handholding attachment to the buckle assembly. Thus, the placement of the handhold attachment may be varied by the disengaging the male and female members, and sliding the female member along the strap before their reinsertion of the male member.

5 Claims, 4 Drawing Sheets

BUCKLE ASSEMBLY AND HAND-HOLD STRAP ATTACHMENT SYSTEM FOR HORSE REINS, BACKPACK STRAPS, CLIMBING ROPE, BELTS, AND THE LIKE

CROSS REFERENCE TO RELATED APPLICATIONS

The present application claims priority to the provisional application having Ser. No. 60/468,370 and entitled "Buckle Assembly and Hand-Hold Strap Attachment System For Horse Reins, Backpack Straps, Climbing Rope, Belts, And The Like", Filed on May 6, 2003 which is incorporated herein by reference.

BACKGROUND OF INVENTION

The present invention relates generally to buckles, and more particularly to a strap-engaging buckles assembly and handhold attachment strap system for horse reins, backpack straps, belts, climbing rope, and the like.

Competitive equestrians are well acquainted with the challenges in attaining a proper position on the horse. Not only is proper positioning essential to attaining the most elegant form in motion, but it is essential to proper balance, horse control, and rider safety. Interestingly, as old as the art of riding may be and as much as the horse became an integral part of Western culture, proper riding mechanics did not by any means become common knowledge and understanding. On the contrary, proper riding mechanics are the province and possession of only those who have devoted considerable time to mastering its subtleties.

Owing to the age of the art, riding equipment is now highly mature and developments are generally but refinements in the art. Many articles and devices have been developed to assist rider control and safety. Even riding reins have been amendable to improvement in recent years, as is evidenced by U.S. Pat. No. 5,148,656 to Meaghan, issued Sep. 22, 1992, which discloses riding reins that facilitate the maneuvering of a horse by providing readily perceptible and identifiable indicia at corresponding locations from the bit so that a rider is able to properly position his hands on the reins to manipulate the horse in the desired manner. The readily perceptible and identifiable indicia can be utilized by an instructor to immediately and clearly instruct a trainee as to the proper positioning of the trainee's hands to control the horse in the desired fashion, or by the trainer to distinguish various tensions on the reins when getting a particular response from the horse. A rider can thus readily appreciate the proper hand positioning and corresponding feel to control the horse in such desired fashion.

A problem frequently encountered when riding is slippery reins. Wet reins can compromise the rider's grip on the reins, forcing the rider to compensate by changing position on the horse, and thereby undermining balance and control. To date, there is no known method or apparatus for enhancing grip on the reins in a manner that will not be undermined in any weather condition, that allows for adjustment, and that will enable instructors to properly position and selectively position the rider's hands on the reins for training.

It is therefore a first objective of the invention to provide a device that permits the rapid and secure adjustment of the length of the reins.

It is yet another object of the invention to provide a method to firmly grip the reins once the length has been properly adjusted.

It is another object of the invention to provide a buckle mechanism that connects at least one strap wherein the length of the strap is continuously variable.

It is a further object to provide the aforementioned features and benefits in a combination of a male and female mating buckle wherein the mating of the buckle components secures the desired length of strap to the buckle combination.

SUMMARY OF INVENTION

The present invention is a strap-engaging buckle assembly and handhold attachment strap system for horse reins, backpack straps, belts, climbing rope, and the like. While intended for a variety of applications, it is especially well adapted for use in providing an equestrian rider with improved grip on the horse reins. In its most essential aspect, it comprises a buckle assembly having mating female and male members, the latter having spring-biased prongs that engage side openings in the female member to provide a snap fit. Prior to buckling, the female member will accommodate a strap or strip of slightly compressible material. The male member includes a wedge portion that cooperates with a ramp portion in the female member to gently push the male member upwardly as it is inserted into the female member. The male member also includes surface structure (teeth) on its upper surface. Accordingly, after a material strip has been inserted through the female member, the male member may be inserted into the female member and pushed inwardly until the teeth compressively engage the inserted material and until the male prongs snap into the side openings of the female member. The buckle assembly thus securely grips the material.

The lower sides of each of the male and female elements include features for attaching, securing or threading a loop or strap type handle thereto. The loop or strap thus functions as a handhold when the buckle assembly is installed as described above. In this manner, the strap-engaging buckle assembly provides a handhold strap that may be employed in a number of environments for a variety of purposes. As noted, it may be employed to provide a handhold in otherwise slippery horse reins. It can also function as a pulling point for tie down straps or ropes, a hanging loop for various backpack straps, a handhold on a climbing rope, and so forth. Further, the device may be used to attached ropes to ropes or straps to staps, omitting the handle attachment deployed for equestrian applications, as the novel buckle assembly provides the benefit of connecting variation linear elements in an assembly with a variable attachment point, that either secure the linear elements or allows them to slide, or be quickly disconnected.

The above and other objects, effects, features, and advantages of the present invention will become more apparent from the following description of the embodiments thereof taken in conjunction with the accompanying drawings.

DETAILED DESCRIPTION

Figure 1:
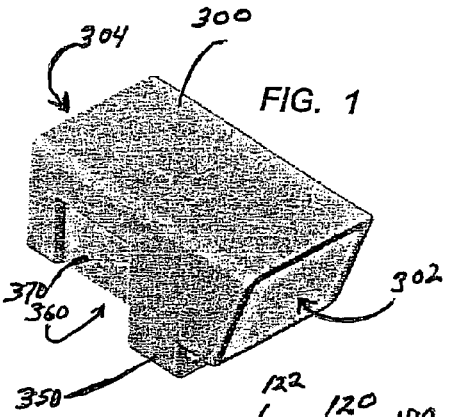
FIG. 1 is a perspective view of a first preferred embodiment of the female member of the strap-engaging buckle assembly and hand-hold attachment strap system of the present invention.

Referring to FIGS. 1 through 12C, wherein like reference numerals refer to like components in the various views, there is illustrated therein a new and improved strap-engaging buckle assembly and hand-hold attachment strap system of the present invention, generally denominated 100 herein.

Figure 2:
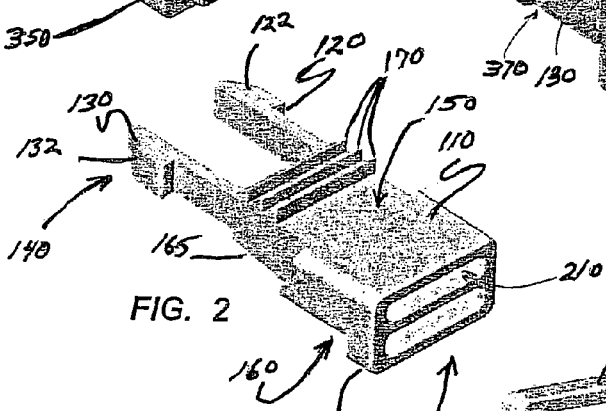
FIG. 2 is a perspective view of the male member of the first preferred embodiment of the buckle assembly.
Figure 3:
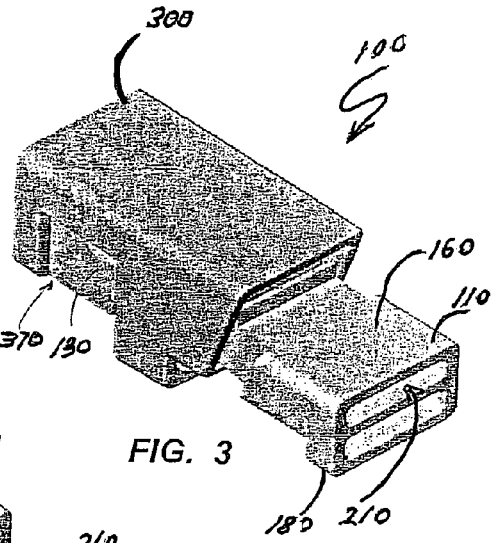
FIG. 3 is an upper front perspective view of the first preferred embodiment of the buckle assembly showing the male member partially inserted into the female member.
Figure 4:
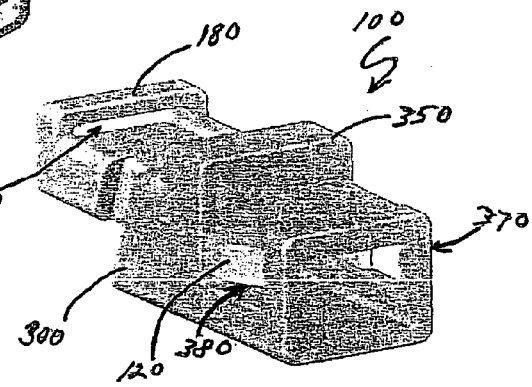
FIG. 4 is a lower rear perspective view of the view of FIG. 3.
Figure 5:
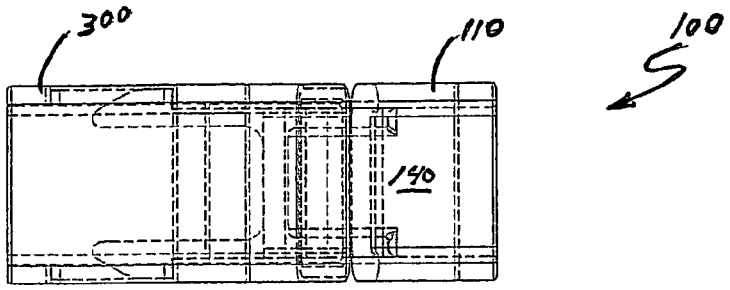
FIG. 5 is a top plan view of the buckle assembly showing the inserted male elements in phantom.
Figure 6:
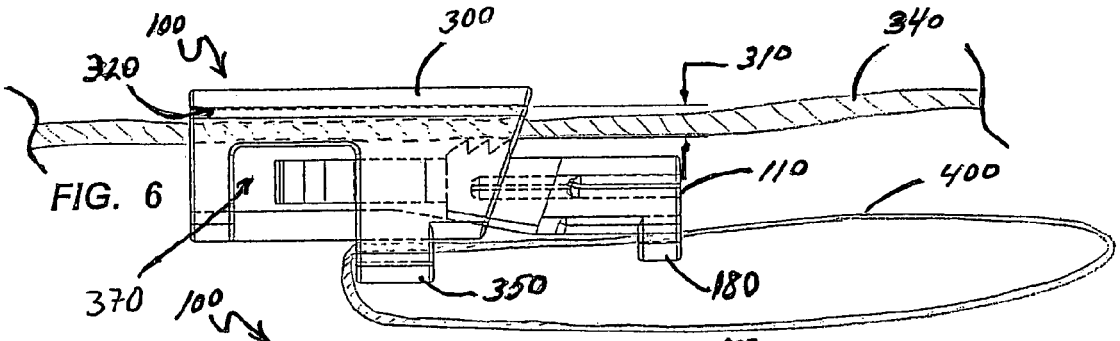
FIG. 6 is a side view in elevation of the buckle assembly of FIG. 5, again showing the inserted male elements in phantom, and further showing a strap threaded through loops in each of the male and female members of the buckle assembly.
Figure 7:
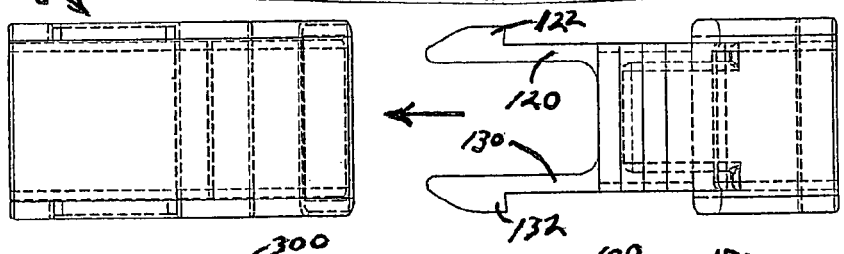
FIG. 7 is a top plan view the female and male members of the buckle assembly with the male member entirely separated from the female member.
Figure 8:
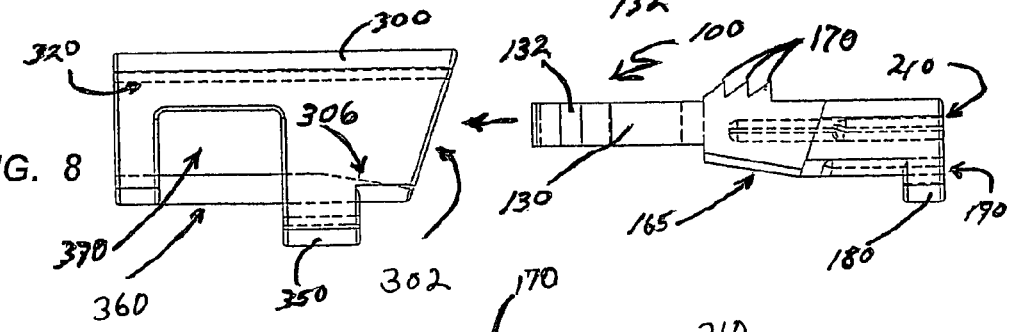
FIG. 8 is a side view in elevation thereof.
Figure 9:
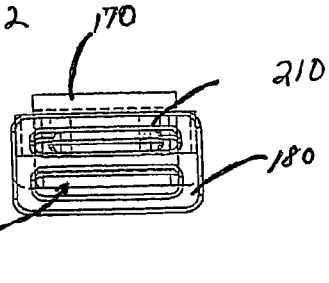
FIG. 9 is an end view in elevation thereof.

FIG. 1 illustrates the female buckle member of the buckle assembly of the first preferred embodiment of the strap-engaging buckle assembly and handhold attachment strap system of the present invention, while FIG. 2 shows the male member, and FIGS. 3 and 4 are perspective views showing the members snapped together. FIGS. 5 through 9 are various views showing the first preferred embodiment of the buckle assembly with the elements inserted and separated. Collectively, these views show that the novel buckle assembly comprises a male member 110 having coplanar flexible prongs 120, 130 at its insertable end 140, as is well known in the art. Each prong includes an expanded end, 122, and 132, respectively adapted for snap insertion to a female member having side openings that will capture the expansions when the male member is sufficiently inserted. The male member includes an upper side 150 and a lower side 160, the lower side including a wedge portion 165 and the upper side including surface structure 170, preferably teeth, which will be used to bear upon a captured length of strap, rope, or reins (see FIG. 6). The lower side 160 includes an integral loop 180 defining an elongate opening 190. The non-insertable end 200 includes a cavity 210, which allows for some compressibility in the upper surface of the male member.

The buckle assembly further includes a female member 300 sized and shaped for the mating reception of the above-described male member and having a first (insertion) end opening 302 and a second end opening 304. However, as is shown most clearly in FIG. 6, when male member 110 is fully inserted into female member 300, there remains a space 310 defined by the upper side 150 and surface structure 170 of the male member and the upper interior surface 320 of the female member. This space permits a strip of fabric, leather and the like forms of material 340 that are generally elongate and slightly compressible to be inserted into the space and captured by the coupled male and female members, via the frictional or mechanical engagement of the surface structure 170 therewith. It should be appreciated that the nature and properties of the surface structure may vary in accordance with the compressibility and the relative coefficient of friction between the strips of material inserted into space 310. Thus, one of ordinary skill in the art will recognize that the surface structure 170 may be relatively non-compressible teeth when the strip of material is compressible, or alternatively may be a compressible material, such as rubber, foam and the like, when the strip of material is less compressible.

The female member also includes a ramp portion 306 proximate its first end opening 302. Further, it includes a loop element 350 on its lower side 360 and side openings 370, 380, to accommodate the expanded ends 122, 132 of the prongs 120, 130 of the male member 110.

Looped through each of the loop elements of the male and female members is a handhold strap 400, which confers upon the inventive apparatus one of its truly novel advantages. In one environment of use, a horse reins 340 is inserted through the first and second end openings 302, 304 of the female member 300; male member 110 is then inserted into female member such that the wedge portion of the male member engages the ramp portion of the female member and urges the entire insertable portion of the male member upwardly and into the horse reins 340. This brings surface structure 170 into compressive engagement with the reins, effectively securing the reins within the coupled buckle assembly. When so captured, the reins will not slip within the buckle assembly, and the strap 400 may be held and pulled forcefully with the riding having confidence that the reins will not disengage there from; in fact, the harder strap 400 is pulled, the more the buckle assembly bears down upon the reins, increasing the holding force thereon.

Figure 10:
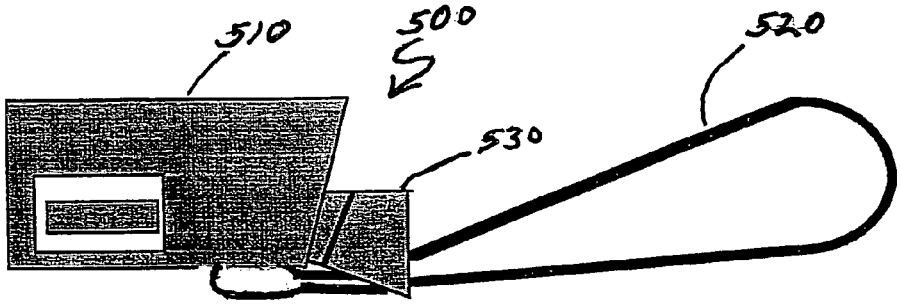
FIG. 10 is a side view in elevation of a second preferred embodiment of the strap-engaging buckle assembly and hand-hold attachment strap system of the present invention.

In a second preferred embodiment 500, FIGS. 10 through 12C, the configurations of the buckle assembly are slightly varied. Specifically, female member 510 includes two slots 512, 514, which allow for looped insertion of a strap 520. Male member 530 includes a single opening 532 for accommodating strap 520. Otherwise, in form and function is essentially identical to that buckle assembly of the first preferred embodiment Preferred strap 520, in FIG. 10 is formed from a length of about 12 to 14 inches (300 to 350 mm) of tubular fabric member, preferably "Nylon" polyamide resin. The fabric tube is flattened by the insertion of a thin plastic that acts as a stiffener, and deforms the fabric tube to a flat or rectangular cross-section of a strap. The reinforced tubular fabric length is the connected at both ends in loop that passes through at least a portion of the female member 510 to forms the hand grippable strap 520. The ends of the fabric strap may be sewn, glued or riveted together, and the like. However, for equestrian application it is preferable to use a plastic rivet as the loop fastening device. The plastic rivet is desirable in that it provides a method of safely releasing rider's hands from the reins, by breaking and opening the loop, in the case or a fall or accident. Hence the plastic rivet assembly is selected to fail when subjected to a load comparable to the weight of the rider, or about 100 to 250 lbs. (50 to 125 Kg.).

Figure 11D:
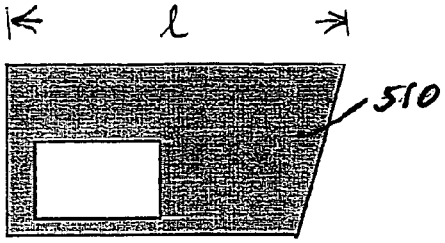
FIG. 11D is a side view in elevation thereof.
Figure 11A:
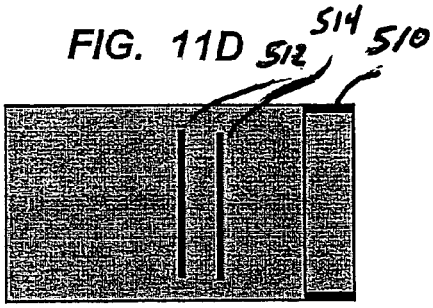
FIG. 11A is a bottom view of the female member of the buckle assembly of the second preferred embodiment.
Figure 11C:
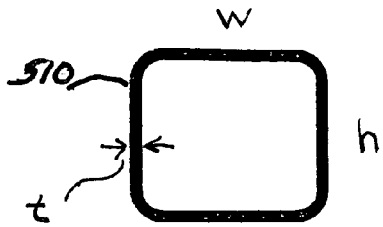
FIG. 11C is an end view thereof.
Figure 11B:
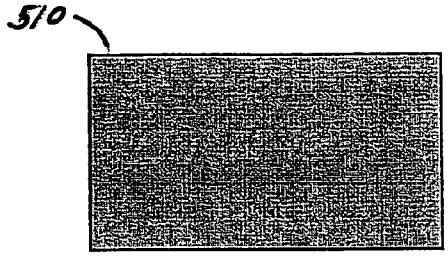
FIG. 11B is a top view thereof.

In the preferred embodiment, Female member 510, as shown in the end view in FIG. 11C, has a width (w) of about 1.25 inches (30 mm) and a height (h) of about 0.875 inches (22 mm). In FIG. 1C the wall thickness (t) of female member

510 is about 0.125 inches (3.2 mm). As shown in the elevation in FIG. 11D, the length (l) of female member 510 of about 2" (50 mm).

It should be understood that the height and width of the female member could vary considerably, depending on the dimension of the rope, rein or flat strapping to be seized therein. Accordingly, the height (H) of the male member 530, and the teeth disposed thereon, would also vary according to the difference between the thickness of the rope, rein or flat strapping and the interior dimensions of the female member, as well as the compressibility and coefficient of friction between the male member and the linear element to be seized in the buckle assembly.

Figure 12A:
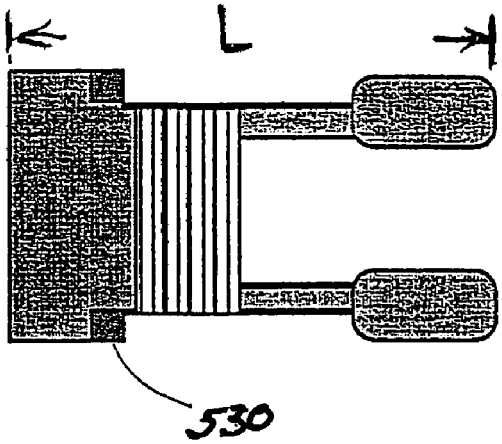
FIG. 12A is a top view of the male buckle member of the buckle assembly of the second preferred embodiment.
Figure 12B:
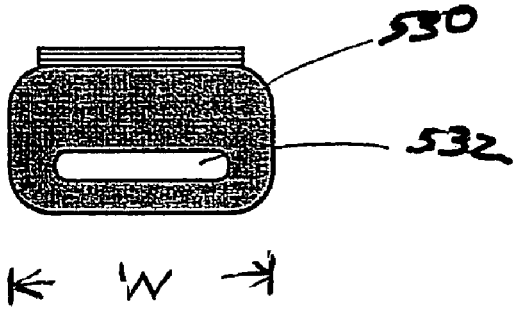
FIG. 12B is an end view elevation thereof.
Figure 12C:
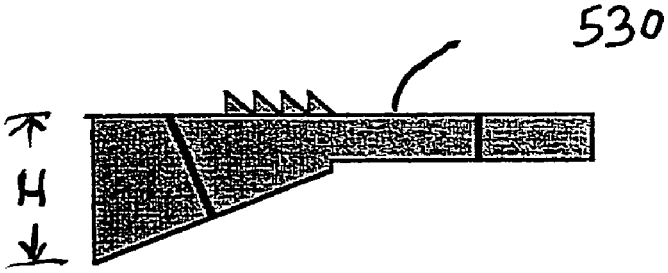
FIG. 12C is a side view elevation thereof.

Thus the corresponding preferred dimensions of the male member 530 corresponding to the female member 510 is provide in FIGS. 12A,B AND C. As shown in the plan view FIG. 12A, the preferred length (L) of male member 530 is about 2.25 inches (57 mm). FIG. 12B illustrates the male member 530 in a first elevation, in which the preferred width (W) is about 1.25 inches (32 mm). The orthogonal elevation, in FIG. 12C, shows the height (H) of the male member 530, excluding the protruding teeth, is about 0.625 inches (16 mm)

In each case, when constructing the male and female member of the buckle assembly it is preferred to employ lightweight materials having high strength and durability. It has been found that plastic, in particular "Delrin" type acetal polymer resin provides the desired mechanical properties and characteristics, though the environment of use will allow for considerable variability in material selection.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features and the like. For instance, it is contemplated that the geometry of the buckle assembly could be altered for capturing cylindrical rope rather than essentially planar fabric strips. More specifically at least a portion of the interior surface of the female member would have a cylindrical cross-section with comparable curvature to the surface of the rope or line to be secured by the buckle assembly. Thus, the buckle assembly could comprise male and female members that could be coupled to provide a handhold strap on a climbing rope or boating lines, or any of a. number of lines used in recreational and commercial settings. The handhold strap can be selectively positioned anywhere along the length of the line or rope simply by uncoupling the buckle members and sliding the line though loop elements on each of the members. In the contemplated environments, however, the essential novel feature is preserved; namely. a buckle assembly having an insertable male portion with at least one wedge portion that cooperates with a female member having a ramp portion to capture an inserted strap/line/rope, etc.

Thus, while the invention has been described in connection with several preferred embodiment, it is not intended to limit the scope of the invention to the particular form set forth, but on the contrary, it is intended to cover such alternatives, modifications, and equivalents as may be within the spirit and scope of the invention as defined by the appended claims.

What is claimed is:

1. A buckle assembly comprising;

a) A substantially rectangular mating female member, having
   - i) a rear opening to accommodate a strap or strip of slightly compressible material,
   - ii) a front opening opposite the rear opening for receiving a male member, and
   - iii) a pair of side openings disposed between the rear and front openings,
   - iv) an interior planar portion that ramps upward from the front opening, b) a mating male member having;
   - i) a forward portion for insertion in the front opening of said female member,
   - ii) a lower surface and an upper surface disposed orthogonal to the forward portion,
   - iii) in the plane perpendicular to the upper and lower surface, a pair of side surfaces,
   - iv) a rear portion opposite the forward portion,
   - v) a pair of spring-biased prongs extending from each of the side surfaces for engaging the side openings in said female member to provide a snap fit therewith,
   - vi) a wedge extending downward from the front of the lower surface that cooperates with the ramp portion in said female member to urge the opposing side of the male member toward the inside of said female member,
   - vii) gripping teeth disposed on the upper surface substantially opposite the wedge, c) wherein after a material strip has been inserted through the female member, inserting the male member into the female member urges the gripping teeth to compressively engage the inserted material strip whereby completing the buckle assembly by snapping the prongs of said male member into the side openings of the female member securely grips the material strip between the teeth and the female member.

2. The buckle assembly of claim 1 further comprising a handle attached to at least one of the female and the male member.

3. The buckle assembly of claim 1 further wherein the male member comprises a substantially non-tapering segment and the ramp disposed between the forward portion and the wedge.

4. The buckle assembly of claim 1 further comprising a loop running through each of male and female.

5. The buckle assembly of claim 4 wherein the loop is attached to the portions of the male and female members that are distal from the inserting portions thereof.

* * * * *